United States Patent [19]

Kessler

[11] Patent Number: 4,615,159

[45] Date of Patent: Oct. 7, 1986

[54] THERMAL WINDOW FRAME

[76] Inventor: Gerald Kessler, Youngstown, Ohio

[21] Appl. No.: 583,261

[22] Filed: Feb. 24, 1984

[51] Int. Cl.[4] ..... E06B 7/12

[52] U.S. Cl. ..... 52/171; 52/398; 52/311

[58] Field of Search ..... 52/171, 172, 397, 398, 52/311; 156/109

[56] References Cited

U.S. PATENT DOCUMENTS

| | | | |
|---|---|---|---|
| 1,706,597 | 3/1929 | Anderson | 52/100 |
| 1,872,309 | 8/1932 | Loebel | 52/172 |
| 2,004,722 | 6/1935 | Hamm | 189/65 |
| 2,157,425 | 5/1939 | Nelson | 189/64 |
| 2,280,389 | 4/1942 | Edwards | 189/75 |
| 3,359,686 | 12/1967 | Kondolf | 49/441 |
| 3,509,592 | 5/1970 | Schrock | 52/172 |
| 3,698,148 | 10/1972 | Marantier | 52/400 |
| 3,992,843 | 11/1976 | DiFazio | 52/398 |
| 4,006,569 | 2/1977 | Kain | 52/397 |
| 4,015,394 | 4/1977 | Kessler | 52/616 |
| 4,057,945 | 12/1977 | Kessler | 52/398 |
| 4,110,942 | 9/1978 | Slocomb, Jr. | 52/100 |
| 4,113,905 | 9/1978 | Kessler | 52/790 |
| 4,187,642 | 2/1980 | Morinaga et al. | 49/406 |
| 4,222,213 | 9/1980 | Kessler | 428/34 |
| 4,259,135 | 3/1981 | Kulla | 156/293 |
| 4,295,305 | 10/1981 | Shelver | 52/172 |
| 4,324,826 | 4/1982 | Ginster | 428/122 |

FOREIGN PATENT DOCUMENTS

| | | | |
|---|---|---|---|
| 1006051 | 3/1977 | Canada | 52/172 |

*Primary Examiner*—Carl D. Friedman
*Assistant Examiner*—Naoko M. Slack
*Attorney, Agent, or Firm*—Browdy and Neimark

[57] ABSTRACT

Flexible ribs on the upper interior facing arm surfaces of a rigid channel member, and the interior facing surfaces of the rigid channel member arms including the surface portions disposed between the ribs, are colored black, so that black sealant which has been smeared over the outer surfaces of a DIG panel located within the channel member, will be camouflaged.

10 Claims, 3 Drawing Figures

THERMAL WINDOW FRAME

FIELD OF THE INVENTION

The present invention relates to thermally insulated glass window frame assemblies, and more particularly to an improved thermally insulated glass window frame assembly having an aesthetically pleasing frame construction.

BACKGROUND OF THE INVENTION

Thermally insulated glass window constructions conventionally employ various forms of an extruded frame of a single piece (for example, such as shown in U.S. Pat. No. 4,006,569 to KAIN) or of two pieces thermally insulated from each other (for example, such as shown in U.S. Pat. No. 3,992,843 to DiFazio) into which is inserted a glass panel known as "double-insulated glass" or DIG, comprising two or more parallel panes of glass thermally insulated from each other by a sealing spacer located at or adjacent the free edge of the panes. The extruded frame constructions, many forms of which are in the public domain, typically are made of plastic, such as PVC or the like, and generally take the form of a rigid, U-shaped channel member provided with flexible ribs on the upper interior facing portions of the arms of the channel member for sealingly retaining the DIG panel and the channel member together.

In the fabrication of thermally insulated glass panel constructions in which the composite glass-spacer-glass edge surface of the DIG panel is coated with a sealant or the sealant is applied to just the edge of the spacer, the extruded frame is first positioned so that the edge surface of the DIG panel faces the base of the channel of the channel member to be installed, and then the channel member is pushed over the DIG panel edge, past the flexible ribs, to or near the bottom of the channel.

The prior constructions made in this manner are structurally sound and thermally efficient, but have proven to be aesthetically unacceptable. The sealants used, most commonly polysulfide, butyl rubber or polyurethane, are black in color, and no matter how carefully applied, there is inevitably some smearing or smudging of the sealant with the result that specks or small pieces or smears (hereinafter collectively "smudges") of the unsightly black solidified sealant find their way to the outside surfaces of the DIG panel adjacent the edge. Even when manufacturers go to the costly extra step of hand-cleaning the glass surfaces adjacent the edges to remove as much of such smudges as possible, the problem remains.

With such smudges on the outer glass surfaces adjacent the DIG panel edge, as the channel member is pushed over the DIG panel edge, these smudges of hardened black sealant are picked up by the interior of the channel member, especially the flexible ribs, and these smudges move along and between the channel member arms and the glass pane surfaces of the inserted DIG panel opposing the channel arms. While cleaning may be effected after such assembly of those portions of the glass surfaces which lie outside of the channel member, such cleaning cannot be extended to those portions of the DIG panel near the edges which portions are covered by the channel members, inasmuch as they are inaccessible from outside the channel members. Thus, when the DIG panel is viewed from one side, through the panes, to the other side, the black sealant smudges on the inserted surfaces of the DIG panel remain visible and are found by customers to be extremely unsightly.

One solution which has been used to solve this problem is to limit penetration of the DIG panel within the channel member to a depth only where the spacer between the panes is completely inserted. While this solution is cosmetically acceptable, the resulting window frame construction is structurally and thermally weak and unsound.

OBJECTS OF THE INVENTION

It is an object of the invention to overcome defects in the prior art, such as mentioned above.

It is another object of the present invention to provide a window frame construction of the type described which is structurally sound, thermally efficient and aesthetically acceptable.

Another object of the present invention is to provide a window frame construction of the type described which is aesthetically acceptable, yet achieves optimal structural and thermal properties by permitting insertion of the DIG panel spacer within the extruded frame channel member to the full extent desirable so as to fully cover the DIG spacer.

These objects are attained by providing black flexible ribs on the upper interior facing surfaces of the rigid channel member arms and also providing that the interior facing surfaces of the rigid channel member arms, including the surface portions disposed between the ribs, be colored black, so that the viscous black sealant which has been smeared over the DIG panel outer surfaces located within the channel member will be camouflaged.

BRIEF DESCRIPTION OF THE DRAWINGS

The invention and its further objects and advantages will be better understood from the following detailed description when referring to the accompanying drawings in which.

DETAILED DESCRIPTION OF THE INVENTION

Figure 1:
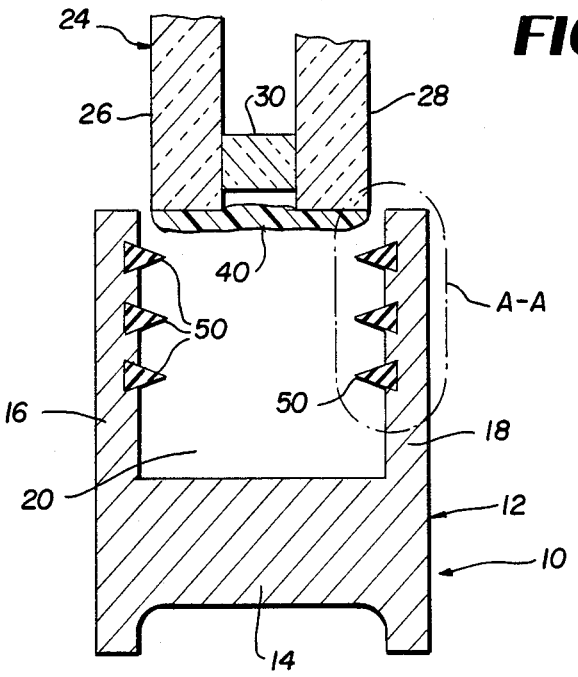
FIG. 1 shows a cross-sectional view of the unassembled extruded frame and DIG panel assembly.
Figure 2:
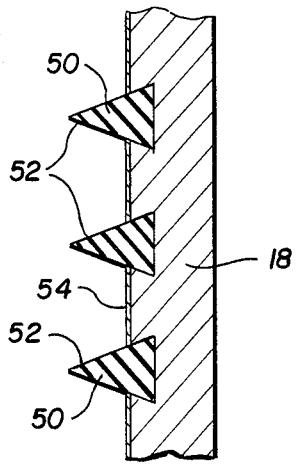
FIG. 2 is an enlarged cross-sectional view of region A—A of FIG. 1.

Referring now to the drawings and particularly to FIGS. 1 and 2, the rigid frame 10 comprises a channel member 12 of generally U-shape having a base 14 and spaced apart, opposing side arms 16, 18 which define a channel or recess 20 for receiving a DIG panel 24 having opposing, outer exposed surfaces 26, 28 separated by a spacer 30, with a sealant 40 applied either solely beneath the spacer 30 or to the entire lower edge of the DIG panel 24.

The side arms 16 and 18 of the channel member 12 each support a plurality of flexible ribs 50 which run longitudinally along the length of the arms and extend toward and into the channel 20. The ribs 50 are spaced apart, have outer surfaces 52 which are black, and may be extruded or co-extruded onto or into the side arms 16, 18. It will be understood that consistent with known practice, the ribs 50 are formed of a flexible or rubbery material such as soft PVC, while the remainder of the channel member 12 is formed of rigid plastic such as rigid PVC.

According to the invention, and as shown in detail in FIG. 2, the surfaces of the arms 16 and 18 which face toward the channel 20, are colored black, and such coloring may be achieved by providing a thin coating 54 of a suitable paint or of plastic, the latter of which may be extruded onto the channel member arms 16 and 18. It will be understood that the black coloring 54 is provided between the ribs 50, above the ribs 50 and below the ribs 50.

Figure 3:
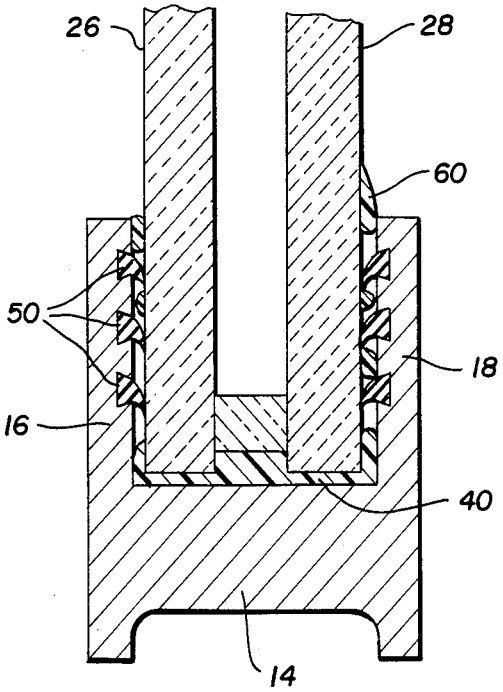
FIG. 3 shows a cross-sectional view of the assembled extruded frame and DIG panel assembly.

FIG. 3 shows the DIG panel 24 after the channel member 12 has been pushed over its edge. The right side of FIG. 3 shows some smudges 60 of the cured sealant 40 after it has been moved up the outside surface of the glass pane 28 by the flexible ribs 50 to a location above the uppermost extent of the side arm 18. The left side of FIG. 3 shows the completed insertion, after the sealant 40 above the top edge of the side arm 16 has been scraped off or otherwise removed. The flexible ribs 50 are deformed downwardly upon insertion of the channel 20 of the channel member 12 over the edge of the DIG panel. After such installation is completed, the smudges of black sealant 40 within the gap between the DIG panel and the respective channel member side arms 16 and 18, when viewed from either side of the DIG panel, are camouflaged or hidden against the black background provided by the coating 54 of the inwardly facing surface of the side arms 16 and 18.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phrasiology or terminology employed herein is for the purpose of description and not of limitation.

What is claimed is:

1. A window frame assembly including rigid channel members secured to the edges of a thermally insulated glass panel having at least two glass panes separated by a spacer element, the channel members having upstanding side arms having a height substantially greater than the height of said spacer element, each said unstanding side arm being spaced from the glass ane adjacent thereto to define a gap therebetween, and flexible ribs supported by each facing interior surface of said side arm extending into the gap and contacting the adjacent glass pane, and the thermally insulated panel being fixedly secured within said channel member and having a dark-colored sealant material applied to the glass panel edges to seal the spacer element therebetween, and means for camouflaging dark sealant material which has been smudged into the gaps between the channel member side arms and the exterior surfaces of said glass panel, said camouflaging means being located within each gap, said camouflaging means comprising said ribs and interior surfaces of said side arms extending the full height of said arms above the height of said spacer which have been darkened to correspond in color to said sealant material.

2. The window frame assembly of claim 1, wherein said sealant material and said camouflaging means is colored black.

3. The window frame assembly of claim 1, wherein said darkened interior surfaces comprise a thin layer of colored material affixed to said side arms.

4. The windown frame assembly of claim 1, wherein said camouflaging means permits insertion of said spacer element into the channel member to its full depth, and thereby defines means for maximizing the structural and thermal integrity of said assembly.

5. A glass window edge frame for use with a thermally insulated glass panel which comprises at least two glass panes separated by a spacer element to be inserted therein, the edge frame comprising a channel member having upstanding side arms with a height substantially greater than the height of said spacer element, and flexible rib means supported by facing interior surfaces of the side arms, and the thermally insulated glass panel being adapted to be fixedly secured within the channel member and having a dark-colored sealant material applied to the edge of the glass panel to seal the spacer element therebetween, and means for camouflaging sealant material smudged into the spaces between the channel member side arms and the exterior surfaces of the glass panel when the latter has been inserted into the channel member, said camouflaging means comprising said ribs and interior surfaces of said side arms extending the full height of said arms about the height of said spacer element darkened to correspond in color to said sealant material.

6. The glass windown edge frame of claim 5, wherein said sealant material and said camouflaging means is colored black.

7. The glass window edge frame of claim 5, wherein said camouflaging means comprises said interior surface and said ribs colored black.

8. The glass window edge frame of claim 5, wherein said interior surfaces comprise a thin coating of colored material affixed to said side arms.

9. The glass window edge frame of claim 8, wherein said thin coating comprises an extrusion.

10. The glass window edge frame of claim 8, wherein said thin coating comprises a layer of paint.

* * * * *

UNITED STATES PATENT AND TRADEMARK OFFICE

CERTIFICATE OF CORRECTION

PATENT NO. : 4,615,159

DATED : October 7, 1986

INVENTOR(S) : Gerald Kessler

It is certified that error appears in the above-identified patent and that said Letters Patent is hereby corrected as shown below:

Column 3, line 49 (Claim 1), after "glass" change "ane" to -- pane --.

Signed and Sealed this

Twenty-third Day of December, 1986

*Attest:*

DONALD J. QUIGG

*Attesting Officer* *Commissioner of Patents and Trademarks*